US006801181B2

(12) United States Patent
Matsumoto et al.

(10) Patent No.: US 6,801,181 B2
(45) Date of Patent: Oct. 5, 2004

(54) LEVEL SHIFTER FOR USE IN ACTIVE MATRIX DISPLAY APPARATUS

(75) Inventors: Shoichiro Matsumoto, Ogaki (JP); Naoaki Komiya, Ogaki (JP); Masahiro Okuyama, Inazawa (JP); Koji Hirosawa, Gifu (JP)

(73) Assignee: Sanyo Electric Co., Ltd. (JP)

( * ) Notice: Subject to any disclaimer, the term of this patent is extended or adjusted under 35 U.S.C. 154(b) by 414 days.

(21) Appl. No.: 09/881,113

(22) Filed: Jun. 14, 2001

(65) Prior Publication Data

US 2002/0030528 A1 Mar. 14, 2002

(30) Foreign Application Priority Data

Jun. 14, 2000 (JP) ..... 2000-179084

(51) Int. Cl.[7] ..... G09G 3/36

(52) U.S. Cl. ..... 345/98; 345/100; 349/42; 326/63; 327/333

(58) Field of Search ..... 345/98, 100; 349/42; 326/63, 68; 327/333

(56) References Cited

U.S. PATENT DOCUMENTS 4,996,443 A * 2/1991 Tateno ..... 326/68
5,399,915 A * 3/1995 Yahata ..... 327/108
5,933,043 A * 8/1999 Utsunomiya et al. ..... 327/333
6,177,824 B1 * 1/2001 Amanai ..... 327/333
6,191,779 B1 * 2/2001 Taguchi et al. ..... 345/204
6,300,927 B1 * 10/2001 Kubota et al. ..... 345/92
6,359,491 B1 * 3/2002 Cairns et al. ..... 327/333
6,359,493 B2 * 3/2002 Satomi ..... 327/333
6,542,144 B2 * 4/2003 Kogure et al. ..... 345/98
6,580,411 B1 * 6/2003 Kubota et al. ..... 345/98
6,593,795 B2 * 7/2003 Cho ..... 327/333

FOREIGN PATENT DOCUMENTS

JP Hei 5-55824 3/1993

* cited by examiner

*Primary Examiner*—Richard Hjerpe
*Assistant Examiner*—M. Fatahiyar
(74) *Attorney, Agent, or Firm*—Cantor Colburn LLP

(57) ABSTRACT

Between a positive power supply 18 and a negative power supply 19, a p-channel transistor 11 and an n-channel transistor 14 are connected in series while a p-channel transistor 12 and an n-channel transistor 15 are also connected in series. An inverted input signal *Sig1 is input to the respective gates of the transistors 11 and 14, while an input signal Sig1 is input to the respective gates of the transistors 12 and 15. As a result, of a pair of the transistors connected in series, namely either the transistors 11 and 14 or the transistors 12 and 15, when one transistor turns ON, the other transistor turns OFF. Thus, generation of through currents is prevented.

9 Claims, 4 Drawing Sheets

LEVEL SHIFTER FOR USE IN ACTIVE MATRIX DISPLAY APPARATUS

BACKGROUND OF THE INVENTION

1. Field of the Invention

The present invention relates to a level shifter for converting an input voltage having a predetermined voltage width into an output voltage having a different voltage width, and more particularly to a level shifter for use in a gate line driver of an active matrix display apparatus.

2. Description of Related Art

FIG. 4 is a circuit diagram showing an example of a known level shifter which comprises a first p-channel transistor 51; a second p-channel transistor 52; a first n-channel transistor 54; a second n-channel transistor 55; a positive power supply 56; and a negative power supply 57.

The operation of the circuit shown in FIG. 4 will be described. When an input signal Sig1 is at a low level, an inverted input signal *Sig1 obtained by inversion of the input signal Sig1 is input to the gate of the first p-channel transistor 51 and the first p-channel transistor 51 turns OFF, whereas the second p-channel transistor 52 turns ON because of the input signal Sig1 being input to the gate thereof. Because the positive power supply 56 is connected to an output terminal via the second p-channel transistor 52, the a high level signal Sig2 is output. Also, the positive power supply 56 is connected to the gate of the first n-channel transistor 54 via the second p-channel transistor 52 to turn the first n-channel transistor 54 ON. Through the first n-channel transistor 54, the gate of the second n-channel transistor 55 is connected to the negative power supply 57, and the second n-channel transistor 55 turns OFF.

When an input signal Sig1 is at a high level, on the other hand, the first p-channel transistor 51 turns ON, whereas the second p-channel transistor 52 turns OFF. Accordingly, the second n-channel transistor 55 turns ON via the first p-channel transistor 51, so that the output terminal is connected to the negative power supply 57 via the second n-channel transistor 55, which causes the level of an output signal Sig2 to be low. Further, the gate of the first n-channel transistor 54 is connected to the negative power supply 57 via the second n-channel transistor 55, so that the first n-channel transistor 54 turns OFF.

In a conventional level shifter, a through current flows from the positive power supply 56 toward the negative power supply 57 when the level of an input signal Sig1 changes from low to high, or from high to low, as will be described below. When an input signal Sig1 is at a high level, the states of the respective transistors are as described above. Namely, the first p-channel transistor 51 is ON; the second p-channel transistor 52 is OFF; the first n-channel transistor 54 is OFF; and the second n-channel transistor 55 is ON. At this time, if the level of the input signal Sig1 changes to low, the states of the transistors sequentially change in the following order:

1) First, the first p-channel transistor 51 turns OFF and the second p-channel transistor 52 turns ON.

2) Then, the gate of the first n-channel transistor 54 opens and the first n-channel transistor 54 turns ON.

3) Finally, charges accumulated in the gate of the second n-channel transistor 55 pass through the first n-channel transistor 54 to the negative power supply 57, and the second n-channel transistor 55 turns OFF.

A certain amount of time is required to complete the above change.

Because both the second p-channel transistor 52 and the second n-channel transistor 55 maintain an ON state during the above change, a through current continuously flows from the positive power supply 56 to the negative power supply 57. As a result, such through currents create a problem of high power consumption.

SUMMARY OF THE INVENTION

In a level shifter according to the present invention, a single input signal is input to gates of two transistors having different conductivity types, of three transistors connected in series. Accordingly, when the level of an input signal changes, either one of the two transistors which are connected in series necessarily turns OFF, thereby preventing a through current from flowing through the three transistors. As a result, power consumption of a level shifter can be reduced, which further results in an active matrix type display apparatus having a long battery life.

In particular, when an active layer of each transistor is configured of low temperature poly-silicon, the advantage of the present invention can be obtained regardless of mobility of the transistors, thereby achieving particularly notable effects.

DETAILED DESCRIPTION OF THE PREFERRED EMBODIMENT

A preferred embodiment of the present invention will be described in further detail with reference to the accompanying drawings.

Figure 1:
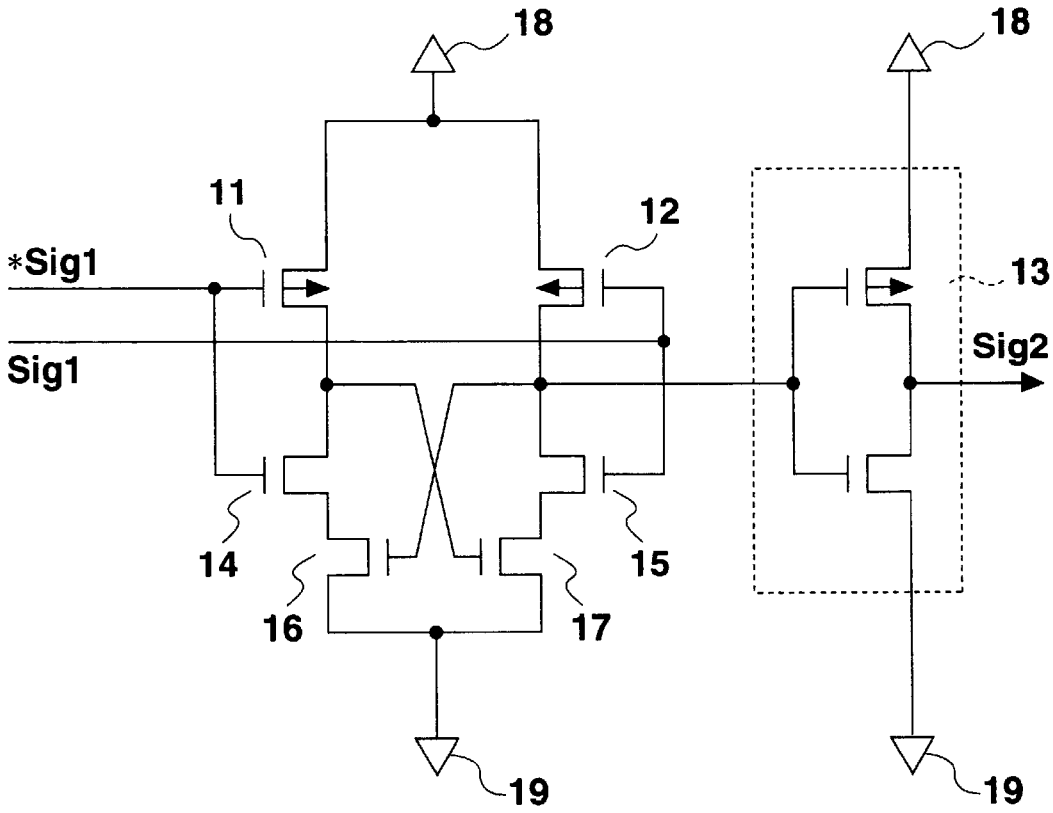
FIG. 1 is a circuit diagram showing a level shifter according to a first embodiment of the present invention.

FIG. 1 is a circuit diagram of a level shifter according to an embodiment of the present invention. Referring to FIG. 1, the level shifter comprises a first p-channel transistor 11; a second p-channel transistor 12; an inverter 13; a first n-channel transistor 14; a second n-channel transistor 15; a third n-channel transistor 16; a fourth n-channel transistor 17; a positive power supply 18; and a negative power supply 19.

An inverted signal *Sig1 obtained by inversion of an input signal Sig1 is input to a gate of the first p-channel transistor 11 and to a gate of the first n-channel transistor 14, while an input signal Sig1 is input to a gate of the second p-channel transistor 12 and to a gate of the second n-channel transistor 15. The first p-channel transistor 11, the first n-channel transistor 14, and the third n-channel transistor 16 are connected in series with one another in this order. Also, the second p-channel transistor 12, the second n-channel transistor 15, and the fourth n-channel transistor 17 are connected in series with one another in this order. Sources of the first and second p-channel transistors 11, 12 are connected to the positive power supply 18, while drains of the third and fourth n-channel transistors 16, 17 are connected to the negative power supply 19. A node between the first p-channel transistor 11 and the first n-channel transistor 14 is connected with the gate of the fourth n-channel transistor 17, and a node between the second p-channel transistor 12 and the second n-channel transistor 15 is connected with the gate of the third n-channel transistor 16, so that a complementary structure is formed. An output signal Sig2 is output from a node between the second p-channel transistor 12 and the second n-channel transistor 15. Finally, the inverter 13 is provided, as a buffer, at the last stage.

The operation of the level shifter according to this embodiment of the present invention will next be described.

First, when an input signal Sig1 is at a low level, the states of the respective transistors are as follows: the first p-channel transistor 11 is OFF; the second p-channel transistor 12 is ON; the first n-channel transistor 14 is ON; and the second n-channel transistor 15 is OFF. Further, the inverter 13 is connected with the positive power supply 18 via the second p-channel transistor 12, so that an output signal Sig2 becomes a low level output, which is a negative power supply voltage V3. The gate of the third n-channel transistor 16 is connected with the positive power supply 18 via the second p-channel transistor 12, and therefore the third n-channel transistor 16 turns ON. Also, the gate of the fourth n-channel transistor 17 is connected to the negative power supply 19 via the first and third n-channel transistors 14, 16, and therefore the fourth n-channel transistor 17 turns OFF.

Then, when the level of the input signal Sig1 changes to high, the states of the respective transistors would change as follows. Namely, the first p-channel transistor 11 is ON; the second p-channel transistor 12 is OFF; the first n-channel transistor 14 is OFF; and the second n-channel transistor 15 is ON. A voltage of the positive power supply 18 is applied to the gate of the fourth n-channel transistor 17 via the first p-channel transistor 11, so that the fourth n-channel transistor 17 turns ON. The inverter 13 is connected with the negative power supply 19 via the second and fourth n-channel transistors 15 and 17, and an output signal Sig2 now becomes a high level output, which is a positive power supply voltage V4. Then, the gate of the third n-channel transistor 16 is connected with the negative power supply 19 via the n-channel transistors 15, 17, the third n-channel transistor 16 turns OFF.

In the level shifter of the present embodiment, because an inverted signal *Sig1 is input to the gates of both the first p-channel transistor 11 and the first n-channel transistor 14, one of these transistors 11 and 14 turns ON while the other turns OFF, regardless as to whether the level of input signal Sig1 is high or low. Therefore, a through current will not flow as long as transition times for the transistors are equal. Similarly, because an input signal Sig1 is input to the gates of both the second p-channel transistor 12 and the second n-channel transistor 15, one of these transistors becomes OFF, thereby preventing a through current from flowing.

Another advantage of the present invention is the enabling of high speed operation. In a conventional level shifter, because of the existence of a through current, a significant time is required to supply a sufficient charge for switching the inverter 53, which in turn lengthens time to raise the output voltage to a prescribed level especially when the level of an output signal Sig2 changes from low to high. In the level shifter of the present embodiment, however, because any through current will be very small, the inverter 13 can be switched faster than the conventional level shifter, which in turn results in faster switching of an output signal Sig2.

Next, an example wherein the above-mentioned level shifter is applied to an active matrix type LCD will be described.

Figure 2:
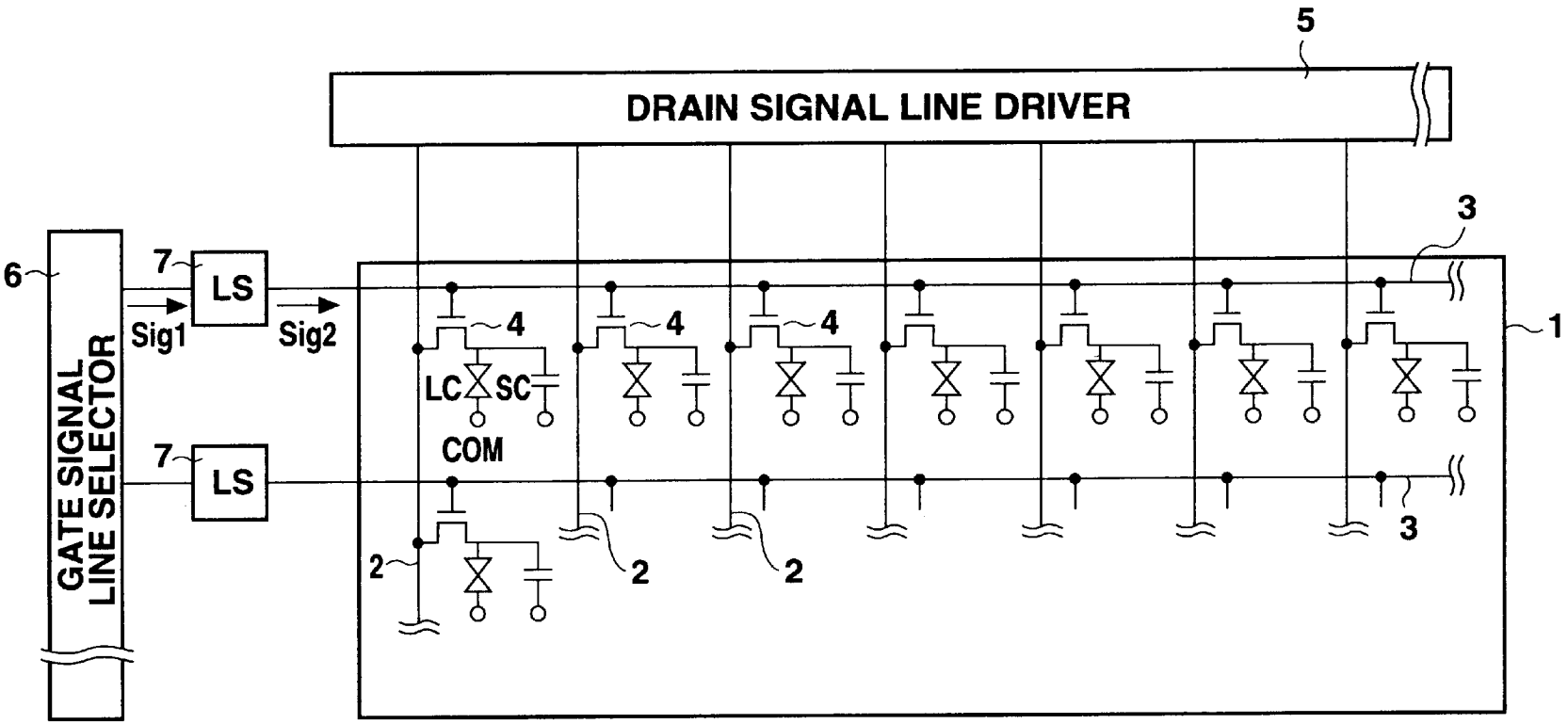
FIG. 2 is a plan view of an active matrix type display apparatus.

FIG. 2 is a circuit diagram showing an active matrix LCD. Referring to FIG. 2, in a pixel region 1, a plurality of drain lines 2 extend in the column direction, and a plurality of gate lines 3 extend in the row direction. At respective intersections between the drain lines 2 and the gate lines 3, a corresponding selection transistor 4 is disposed. A selection transistor 4 is so structured that a drain and a gate are connected with the drain line 2 and the gate line 3, respectively, and a source is connected with a pixel electrode formed for each pixel. Outside the pixel region 1 in the column direction is provided a drain line driver 5 for sequentially selecting a predetermined drain line 2 and applying a data voltage thereto. Further, outside the pixel region 1 in the row direction is provided a gate line selector 6 for selecting a gate line 3.

The gate line selector 6 sequentially selects a predetermined gate line 3 among a plurality of gate lines 3 and applies a gate voltage to the selected gate line 3, to thereby turn ON the selection transistor 4 connected to the selected gate line 3. The drain line driver 5, on the other hand, sequentially selects a predetermined drain line 2 from a plurality of drain lines 2, and outputs a data signal to the selected drain line 2. A pixel voltage in accordance with a data signal is applied to the pixel electrode of the pixel connected with the selected gate line 3 and the selected drain line 2 through the drain line 2 and the selection transistor 4 which is now ON, and the corresponding liquid crystal LC is driven, so that display is performed.

When performing line inversion driving in which a voltage to be applied to the pixel electrode, i.e., a pixel voltage, is inverted each row, a drive method called "common electrode AC drive" in which voltage of a common electrode COM is simultaneously inverted, is sometimes employed in order to reduce the maxim value of the pixel voltage. As described above, a pixel voltage is applied via the selection transistor 4 to the pixel electrode corresponding to the selected gate line. At this point, the pixel electrodes corresponding to other unselected gate lines are in the state of floating because the corresponding selection transistors 4 are OFF. When common electrode AC drive is performed under these conditions, the potential of the unselected pixel electrode in the state of floating varies following the inversion of the common electrode COM. As a result of such a potential change, there is a possibility that the difference between the potential of the pixel electrode and the gate potential of the selection transistor 4 may be eliminated, thereby causing the selection transistor 4 to turn ON. In order to prevent this, it is necessary to apply a negative voltage to the selection transistor 4 which is not selected, in an active matrix display apparatus in which the common electrode AC drive is performed. By applying a negative voltage, it is possible to maintain the potential difference between the pixel electrode and the gate electrode, to thereby prevent the selection transistor 4 from turning ON, even when the potential of the pixel electrode changes.

Figure 3:
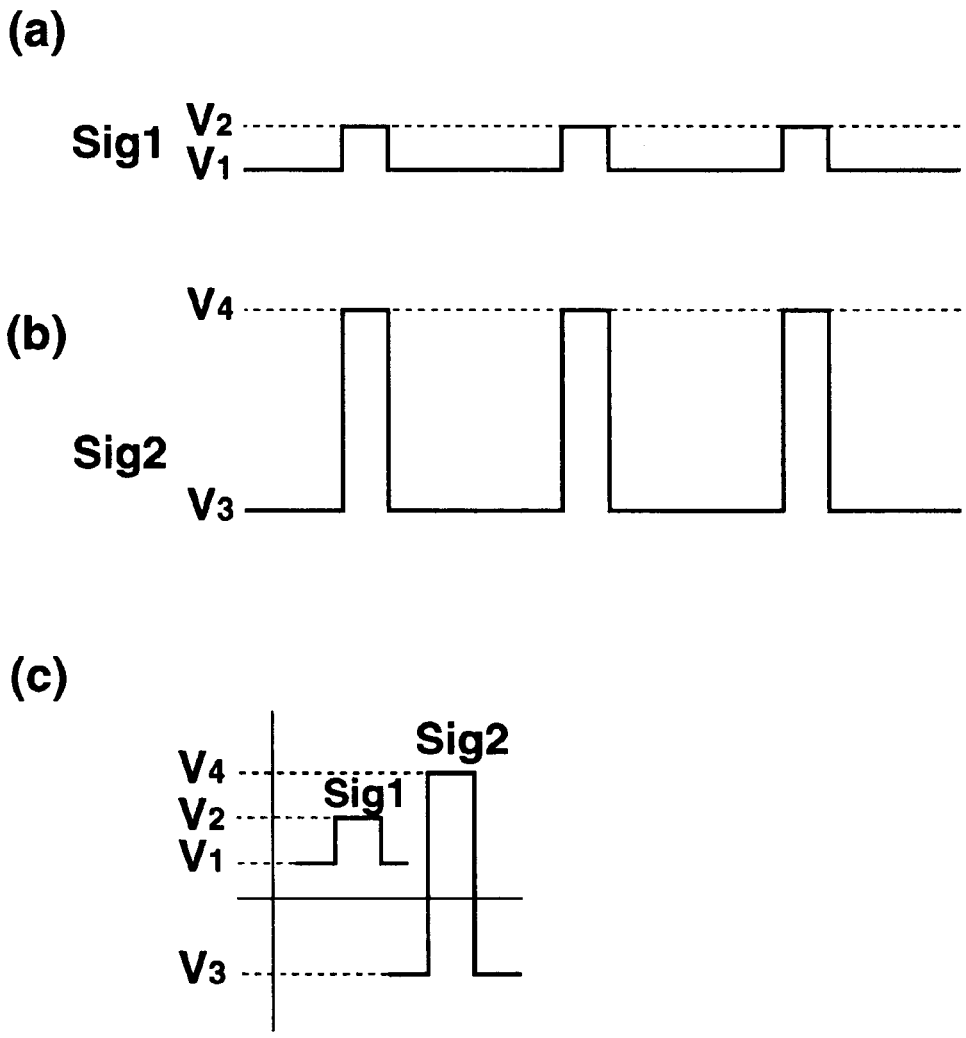
FIG. 3 is a diagram for explaining an operation of the level shifter according to the present invention.
Figure 4:
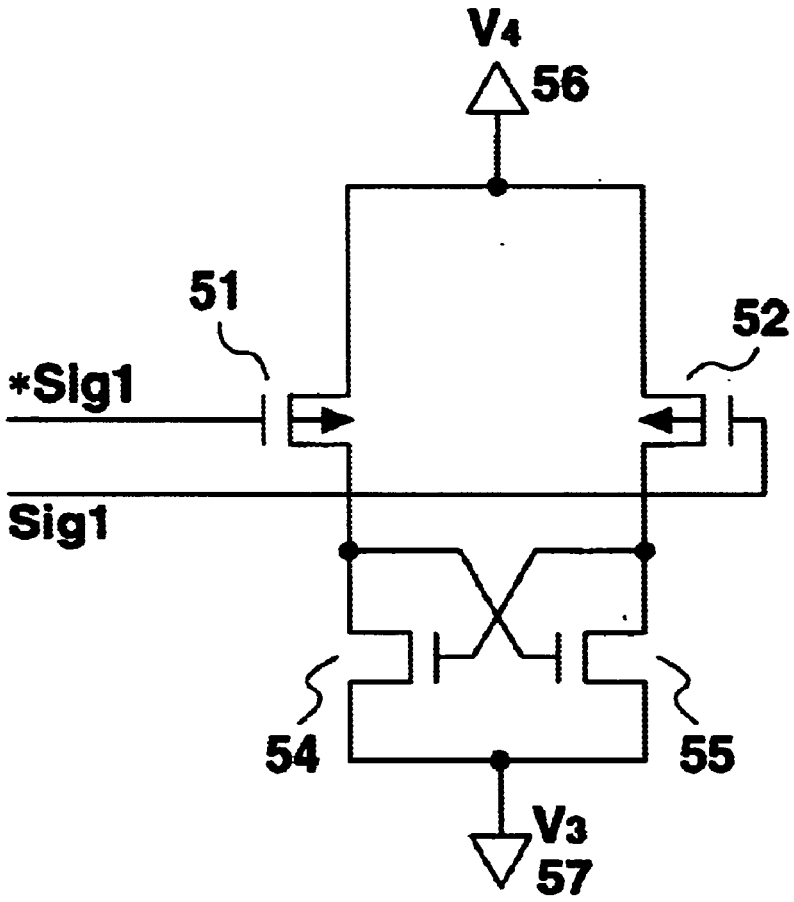
Fig. 4 Prior Art
FIG. 4 is a circuit diagram showing a prior art level shifter.

The gate line selector 6 performs output at a level between ground and a predetermined potential as shown in FIG. 3(*a*). Therefore, a level shifter 7 is disposed between the gate line selector 6 and the gate line 3, as shown in FIG. 2. The level shifter 7 is a voltage conversion circuit which outputs a signal having a second voltage width shown in FIG. 3(*b*) with regard to an input signal having a first voltage width shown in FIG. 3(*a*). In particular, the level shifter 7 outputs a signal having a voltage width between the negative voltage V3 and the positive voltage V4 as shown in FIG. 3(*c*).

It should be noted that a voltage of the positive power supply 18, namely V4, is at least higher than a threshold voltage which turns the selection transistor 4 ON, while a voltage of the negative power supply 19, i.e., V3, is lower than the minimum voltage which can change the potential of the pixel electrode by the common electrode AC drive.

In the present embodiment, the level shifter having a structure shown in FIG. 1 is used as the level shifter 7. Therefore, the through current which is generated each time the gate line is selected can be reduced. The level shifter 7 is provided for each gate line, so that a large number of level shifters 7, for example 240 or 480 level shifters, are provided in one display screen. Besides, since any one of the gate electrodes necessarily turns ON or OFF for each one horizontal period, the number of times the gate electrodes are switched ON and OFF is very large. Accordingly, the effect of reduction in power consumption can be especially obtained.

Further, in the case of a low temperature poly-silicon TFT in which a circuit is fabricated directly on an insulating transparent substrate having a low melting point, such as glass, the problem of through current is more serious because of low charge mobility of individual transistors. Low temperature poly-silicon is formed as follows. Namely, on an insulating transparent substrate having a lower melting point than that of a silicon substrate and a quartz substrate, such as glass, amorphous silicon is first formed. Then, the amorphous silicon is crystallized by a process, such as laser annealing, using a lower temperature than the melting point of the substrate (approximately 700° C., though there are cases where heating at approximately 800° C. is performed in a very short period, such as several seconds or less), to thereby obtain low temperature poly-silicon. The use of low temperature poly-silicon advantageously reduces cost and allows for downsizing of a display apparatus, because peripheral control circuits as well as pixels can be fabricated on a glass substrate. On the other hand, it is disadvantageous in that, due to the low temperature used for polycrystallization, there are many grain boundaries and the poly-silicon has low charge mobility. When a conventional level shifter is formed on a glass substrate using a thin film transistor (low temperature poly-silicon TFT) comprising this low temperature poly-silicon as an active layer, a relatively longer time is required to change the state of the second n-channel transistor 15 because a greater through current flows. When the level shifter according to the present embodiment is adopted, on the other hand, a through current flows only during an output transition time of the inverter 13, and the through current can thus be reduced even when a low temperature poly-silicon TFT with low mobility is used. As described above, the present invention can achieve a significant effect when applied to an active matrix type display apparatus using a poly-silicon TFT.

The applicant of the present invention simulated an operation which raised the level of an output signal Sig2 from V3 (−2V) to V4 (10V) and then lowered it back to V3 (−2V), in both a conventional level shifter circuit and a level shifter circuit of the present embodiment which are both formed by low temperature poly-silicon TFTS. According to this simulation, when the level of the output signal Sig2 changed from low to high, the through current in the conventional level shifter was 14.4 pA whereas the through current in the level shifter of the present embodiment was 11.2 pA. When the output Sig2 level changes from high to low, on the other hand, the through current of 3.0 pA in the conventional level shifter was reduced to 1.6 pA in the level shifter of the present embodiment. As a result, the through current was reduced by 26.4% in total.

While the preferred embodiment was described using an active matrix type LCD as an example, the present invention can also be applied to other type of active matrix type display apparatuses, including, for example, an organic EL display apparatus, an LED display apparatus, a vacuum fluorescent display apparatus, or the like.

Likewise, while the preferred embodiment of the present invention was described using other specific terms, such description is for illustrative purposes only, and it is to be understood that changes and variations may be made without departing from the spirit or scope of the appended claims.

What is claimed is:

1. A level shifter for changing the level of an input signal and outputting the signal, comprising:

a first transistor, a second transistor, and a third transistor which are connected in series between a first power supply and a second power supply; and a fourth transistor, a fifth transistor, and a sixth transistor which are connected in series between said first power supply and said second power supply;

said first transistor and said forth transistor being transistors of a first conductivity type, and said second transistor, said third transistor, said fifth transistor, and said sixth transistor being transistors of a second conductivity type, wherein, of a pair of input signals having complementary phases, one input signal is input to a gate of said first transistor and a gate of said second transistor, and the other input signal is input to a gate of said fourth transistor and a gate of said fifth transistor, a node between said first transistor and said second transistor is connected to a gate of said sixth transistor, and a node between said fourth transistor and said fifth transistor is connected to a gate of said third transistor, and an output signal is output from a node between said fourth and fifth transistors, said output signal being used for level shifting of gate lines for selecting a pixel in an active matrix type crystal-display apparatus.

2. A level shifter according to claim 1, wherein said active matrix type liquid display apparatus comprises:

a plurality of gate lines for selecting a pixel;

a plurality of signal lines disposed so as to intersect with said gate lines; and a gate line selector for selecting said gate lines, said level shifter being disposed between said gate line selector and each of said gate lines.

3. A level shifter according to claim 2, wherein an active layer of each of said transistors is low temperature poly-silicon.

4. A level shifter according to claim 1, wherein said output signal is further inverted by an inverter.

5. A level shifter for changing the level of an input signal and outputting the signal, comprising:

a first transistor, a second transistor, and a third transistor which are connected in series between a first power supply and a second power supply; and a fourth transistor, a fifth transistor, and a sixth transistor which are connected in series between said first power supply and said second power supply;

said first transistor and said forth transistor being p-channel transistors, and said second transistor, said third transistor, said fifth transistor, and said sixth transistor being n-channel transistors, wherein, of a pair of input signals having complementary phases, one input signal is input to a gate of said first transistor and a gate of said second transistor, and the other input signal is input to a gate of said fourth transistor and a gate of said fifth transistor, and a node between said first transistor and said second transistor is connected to a gate of said sixth transistor, and a node between said fourth transistor and said fifth transistor is connected to a gate of said third transistor, and an output signal is output from a node between said fourth and fifth transistors.

6. A level shifter according to claim 5, wherein said output signal is used for level shifting of gate lines for selecting a pixel in an active matrix type liquid display apparatus.

7. A level shifter according to claim 6, wherein said active matrix type liquid display apparatus comprises:

a plurality of said gate lines for selecting a pixel;

a plurality of signal lines disposed so as to intersect with said gate lines; and a gate line selector for selecting said gate lines, said level shifter being disposed between said gate line selector and each of said gate lines.

8. A level shifter according to claim 7, wherein an active layer of each of said transistors is low temperature polysilicon.

9. A level shifter according to claim 5, wherein said output signal is inverted by an inverter.

* * * * *